United States Patent [19]

Tikes

[11] Patent Number: 4,720,693

[45] Date of Patent: Jan. 19, 1988

[54] RIDGED RECTANGULAR WAVEGUIDE PROVIDED WITH A SEALED WINDOW

[75] Inventor: Jacques Tikes, Orsay, France

[73] Assignee: Thomson-CSF, Paris, France

[21] Appl. No.: 815,141

[22] Filed: Dec. 30, 1985

[30] Foreign Application Priority Data

Dec. 28, 1984 [FR] France ..... 84 19997

[51] Int. Cl.[4] ..... H01P 1/08

[52] U.S. Cl. ..... 333/252; 333/35

[58] Field of Search ..... 333/252, 254, 34, 35

[56] References Cited

U.S. PATENT DOCUMENTS

| | | | |
|---|---|---|---|
| 2,882,502 | 4/1959 | Freundlich | 333/252 |
| 2,894,228 | 7/1959 | Geisler, Jr. | 333/252 |
| 2,927,288 | 3/1960 | Ray | 333/252 |
| 2,932,806 | 4/1960 | Burr, Jr. | 333/252 |
| 3,098,207 | 7/1963 | Gordon et al. | 333/252 |
| 3,387,237 | 6/1968 | Cook | 333/252 |
| 3,593,224 | 7/1971 | Eggers et al. | 333/252 |
| 3,675,165 | 7/1972 | Veda et al. | 333/252 |
| 3,781,726 | 12/1973 | Thompson | 333/252 |
| 3,860,891 | 1/1975 | Hiramatsu | 333/252 X |
| 4,352,077 | 9/1982 | Gerlack | 333/252 |
| 4,358,744 | 11/1982 | Tikes | 333/252 X |
| 4,556,854 | 12/1985 | Hiramatsu | 333/252 X |

FOREIGN PATENT DOCUMENTS

| | | | |
|---|---|---|---|
| 2558306 | 7/1986 | France | 333/252 |

*Primary Examiner*—Paul Gensler
*Assistant Examiner*—Benny T. Lee
*Attorney, Agent, or Firm*—Cushman, Darby & Cushman

[57] ABSTRACT

A thin waveguide window having a broad band of operating frequencies is composed of a metallic frame provided with an opening and a leak-tight closure plate of dielectric material. The frame permits a reduction in dimensions of the plate, with the result that any spurious frequencies introduced by the plate are rejected from the operating frequency band. By giving the plate an oblong shape, it is possible to balance its inductive components by means of its capacitive components at the mid-band frequency. A matching transformer formed by the ridges which are more closely spaced in the vicinity of the window than in the remainder of the waveguide permits matching throughout the frequency band.

8 Claims, 14 Drawing Figures

FIG_4
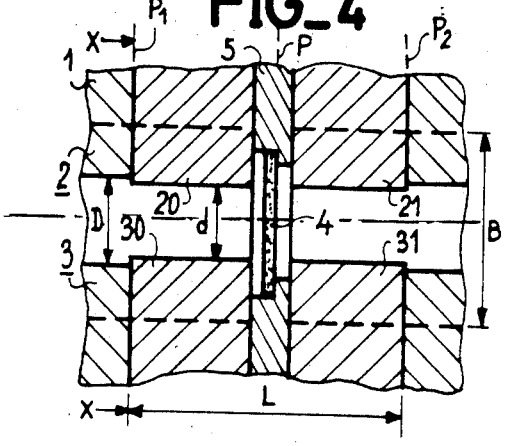
FIG_5
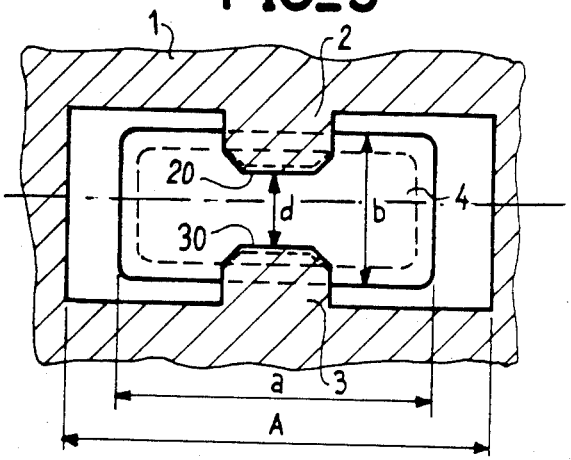
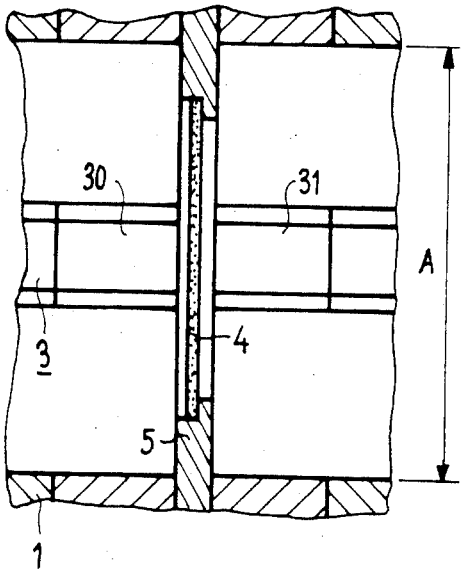
FIG_6

RIDGED RECTANGULAR WAVEGUIDE PROVIDED WITH A SEALED WINDOW

BACKGROUND OF THE INVENTION

1. Field of the Invention

This invention relates to rectangular waveguides and more particularly to ridge waveguides of the type in which provision is made for a sealed window or in other words a partition-wall which is transparent to electromagnetic energy but impervious to gases and moisture.

2. Description of the Prior Art

When a wide band of operating frequencies is desired for a rectangular waveguide provided with a sealed window, an attractive possibility consists in adopting a ridge waveguide. It is known that, in a device of this type, one or more longitudinal internal ridges are formed in the waveguide walls, primarily in order to increase transmission bandwidth by lowering the cutoff frequency. A waveguide corresponding to this definition and provided with a window has already been disclosed in U.S. Pat. No. 3,860,891 issued on Jan. 14, 1975, and which is a continuation in part application of U.S. Ser. No. 102,590, filed Dec. 30, 1970, now abandoned. This patent describes a thick dielectric window with a small transition zone on each side in which the internal ridges are suppressed and in which the cross-section of the waveguide has a height equal to the maximum height of the waveguide section which contains the dielectric material of the window. Unfortunately, this window-type waveguide has an operating frequency bandwidth which is limited to one octave and is liable to produce parasitic resonances or ghost modes arising from the thickness of the dielectric.

SUMMARY OF THE INVENTION

The aim of the present invention is to provide a ridge waveguide with a sealed window while retaining an operating frequency bandwidth which covers more than one octave.

This result is primarily obtained by adopting the combination of a metallic frame, a thin dielectric plate placed within the frame and an impedance transformer.

In accordance with the invention, there is provided a rectangular ridge waveguide having a sealed window of small thickness composed of a metallic frame and a dielectric plate. The frame is pierced by an opening which is shut-off by said dielectric plate said opening being of oblong shape in projection on a transverse plane of the waveguide. The longest dimension of said oblong opening is parallel to the long sides of the waveguide whilst the overall dimensions of said opening, which are parallel respectively to the long and short sides of the waveguide, are respectively smaller than the dimensions of said long and short sides of the waveguide. The waveguide is provided with a matching transformer which is placed in a zone located on each side of said window, said transformer being obtained by giving the waveguide ridges a greater thickness inside the zone than outside said zone.

BRIEF DESCRIPTION OF THE DRAWINGS

Other features of the invention will be more apparent upon consideration of the following description and accompanying drawings, wherein:

FIGS. 4 to 6 are three sectional views of a waveguide in accordance with the invention;

In the different figures, corresponding elements are designated by the same references.

DETAILED DESCRIPTION OF THE PRESENTLY PREFERRED EXEMPLARY EMBODIMENT

In the following description and in the appended claims, reference will be made to "thin windows". This term will be understood to designate windows in which the dielectric has a thickness which represents an electrical length at least five times shorter than the guided wavelength corresponding to the signal at the highest operating frequency within the waveguide.

Figure 1:
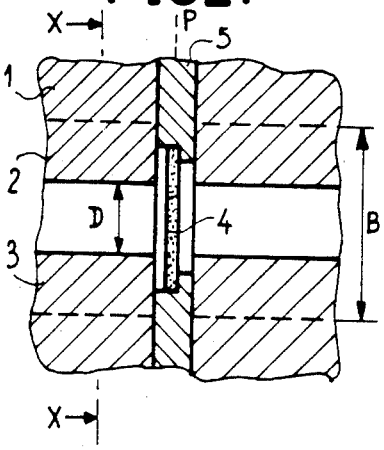
FIGS. 1 and 2 are two sectional views of a ridge waveguide equipped with a sealed window according to a preparatory study by the inventors.
Figure 2:
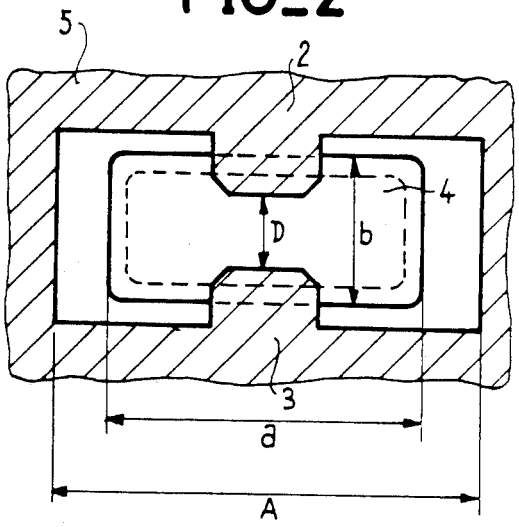

In accordance with a preparatory study by the inventors, FIGS. 1 and 2 illustrate a rectangular waveguide 1, the long and short sides of which have respectively a width A and a width B. FIG. 1 is a longitudinal sectional view of said waveguide taken along a plane of symmetry of the waveguide. FIG. 2 is a transverse sectional view taken along a plane corresponding to the line X—X indicated in FIG. 1. The waveguide of FIGS. 1 and 2 has two identical longitudinal ridges 2 and 3 disposed respectively at the midpoint of the two long sides and spaced apart at a distance D. During the preparatory study which has led to the waveguide herein disclosed and claimed, a thin sealed window composed of a metallic frame 5 (of ferronickel which surrounds a dielectric plate 4 of ceramic material) has been placed within the waveguide at right angles to the four sides of the waveguide. Plate 4 has the shape of a rectangle with rounded corners and dimensions a and b, the long sides a and short sides b are respectively parallel to the long sides A and short sides of B the waveguide 1.

Measurements have been made with respect to frequency bands having limiting frequencies F1 and F2 and a center frequency $F_0$ with $F_2$ higher than F0 which is higher than $F_1$, and $\lambda_0$, $\lambda_1$, $\lambda_2$ having the guided wave lengths corresponding to the frequencies $F_0$, $F_1$, $F_2$. Experience has shown that, when the inductive component determined by the difference A−a and the capacitive component determined by the difference B−b of the impedance in the plane P of the frame are equal at the frequency $F_0$, the window (4,5) exhibits in the plane P a susceptance which is symmetrical with respect to the real axis (axis of pure resistances) and passes through the center (1, 0) of said axis on the Smith chart.

Figure 3:
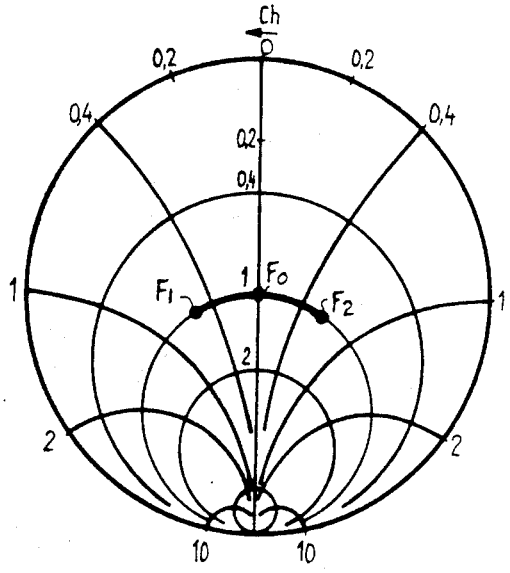
FIG. 3 is a Smith chart relating to the waveguide in accordance with FIGS. 1 and 2.
Figure 7A:
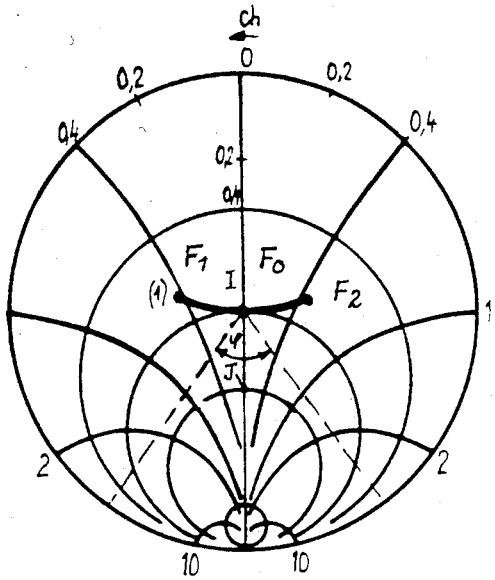
FIGS. 7(*a*), (*b*), (*c*), and (*d*) are Smith charts relating to the waveguide in accordance with FIGS. 4 to 6.
Figure 7B:
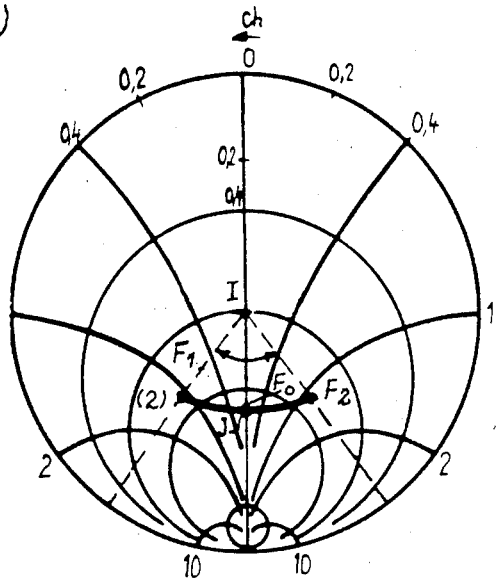
Figure 7C:
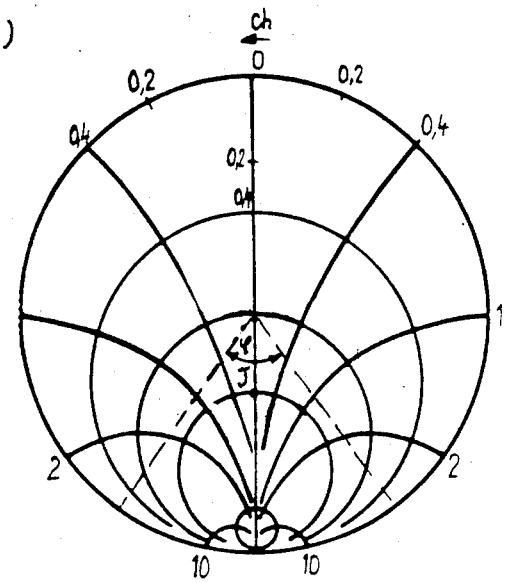
Figure 7D:
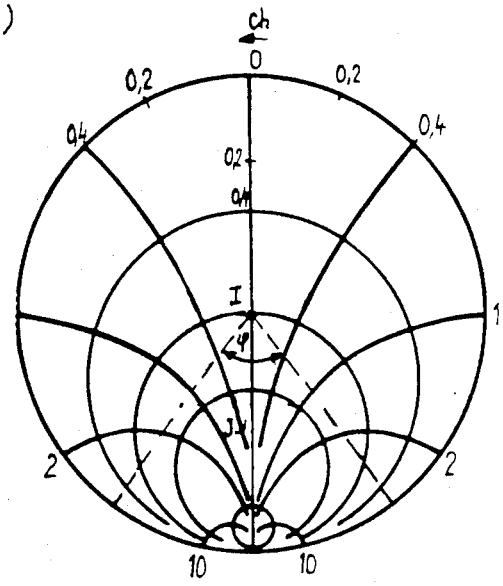

FIG. 3 is a representation of the curve of susceptance aforesaid in a Smith chart in which the source-to-load direction of displacement has been indicated by an arrow Ch. The susceptance varies uniformly as a function of the frequency, passing successively through pure inductive values (zero at $F_0$) and pure capacitive values in the direction of increasing frequencies of the band $F_1$ to $F_2$. Matching is therefore correct only for the frequency $F_0$. In order to accomplish matching throughout the frequency band $F_1$ to $F_2$, it is proposed to add a half-wave transformer and thus to achieve a broad-band match.

FIGS. 4 to 11 show how a matching transformer of this type can be employed and shows the effect thus produced on the curve of susceptance (as shown in FIGS. 7(*a*), (*b*), (*c*), and (*d*).

FIGS. 4, 5 and 6 show how the waveguide in accordance with FIGS. 1 and 2 can be modified in order to incorporate therein an impedance-matching transformer of the half-wave type. FIGS. 4 and 5 differ respectively from FIGS. 1 and 2 only in the fact that the distance between the ridges 2 and 3 have been reduced over a length $L=\lambda_0/2$ on each side of the sealed window (4,5) in order to change-over from the relative spacing D to the spacing d. The ridge sections which all have the same length and are located on each side of the window (4,5) are designated by the references 20 and 21 in the case of the ridge 2 and by the references 30 and 31 in the case of the ridge 3. FIG. 6 has been given as a complement to FIGS. 4 and 5 in order to permit a more complete understanding of the method of construction of the waveguide. This view is a transverse cross-section taken along the plane of symmetry of the waveguide which is parallel to the long sides of said waveguide, the section lines of this view are shown as axis lines in FIGS. 4 and 5.

In FIG. 4, three planes of observation of the waveguide have been indicated: plane $P_1$ located against the impedance transformer constituted by the closely-spaced ridge sections which extend over the distance $L=\lambda_0/2$ nearest the source which is coupled to the waveguide; plane $P_2$ located against the impedance transformer but on the side remote from the source: plane P located at the level of the window (4,5).

As indicated on the charts of FIGS. 7(*a*), (*b*), (*c*), and (*d*), before and against the observation plane $P_1$, the window (4,5) exhibits the susceptance curve (1) which corresponds to the curve of FIG. 3 after a rotation has taken place through an angle of 180° about the point I of coordinates (1, 0) and which is due to the transformer.

After and against the observation plane $P_1$, the curve (1) of FIGS. 7(*a*), (*b*), (*c*), and (*d*) undergoes a resistive translation which is a function of the relative spacing d and becomes curve (2). If $\phi$ designates the angle having a vertex which is the point I and having sides which pass through the extremities of the curve (2) relating to the frequencies $F_1$ and $F_2$, the value of the relative spacing d of the half-wave transformer is so adjusted as to ensure that said angle $\phi$ is equal to the difference of rotation (towards the load: arrow Ch) of the points which are representative of the frequencies $F_1$ and $F_2$ along the transformer, that is:

$$\phi = \pi \cdot \lambda_0 \cdot \left( \frac{1}{\lambda_2} - \frac{1}{\lambda_1} \right)$$

Therefore, the waveguide section of length L behaves as a collection space. In the observation plane $P_2$, after a rotation towards the load on a circle having a constant standing-wave ratio of the Smith chart, all the points relating to the different frequencies of the band meet at J, then at I.

In more detail, the four steps performed on the Smith chart to show that all the points relating to the different frequencies of the band meet at J, then at I will be described as follows. FIG. 3 represents the susceptance curve of the window alone, as seen in a reference plane P (see FIG. 4) passing midway through the window. This susceptance is referred to the characteristic admittance of the standard ridged waveguide. In order to more easily explain the combination of the susceptance of the window alone with that of the transformer, it is best to proceed in four steps. First, it will be necessary to determine the susceptance of the window alone as seen in plane P1 (FIG. 4) but on the left side of this plane, that is in the standard ridged waveguide. In the second step, it will be necessary to introduce the effect of the change in height of ridges which occurs in plane P1 by finding the susceptance still as seen in plane P1, but on the right side of this plane in the reduced height waveguide. In the third step, it will be necessary to add the influence of the transformer length by finding the susceptance as seen in plane P2, at the other end of the transformer, on the left side of this plane, still in the reduced height waveguide. Finally, it will be necessary to add the influence of the change in height of ridges occurring in plane P2 by finding the susceptance as seen in plane P2 but on the right side of this plane, in the standard ridged waveguide. When these four transformations have been accomplished, the effect of the half-wave transformer on the window of susceptance will have been fully taken into account. Then, it will be seen that the result is, by property of the changes in height of the ridges, a very good and very broad match.

Step 1: In FIG. 7(*a*), curve (1) represents the susceptance curve of the window (4, 5) alone in a reference plane P1, located at a distance from P equal to approximately ¼th of the guided wavelength at the central frequency, and towards the RF source (i.e. toward the left of FIG. 4). This curve is obtained from FIG. 3, as known in waveguide theory, by rotating each point of the curve of FIG. 3 about the center of the diagram by an angle corresponding to the electrical length between planes P and P1 at the corresponding frequency. The result of this transformation is, with very good approximation, a simple rotation by 180° of the initial curve about the center of the diagram.

Step 2: To obtain the susceptance still viewed in the plane P1, but referenced to the characteristic admittance of the ridged waveguide constituting the half-wave transformer (20, 21), the curve (1) of FIG. 7(*a*) is translated (see curve (2) of FIG. 7(*b*)) as known in waveguide theory by a vector parallel to the conductance axis on the Smith chart and corresponding to the ratio of the characteristic admittances of the two waveguides on either side of plane P1.

Step 3: Now, the susceptance measured in plane P2, inside the transformer guide, will be determined. According to waveguide and Smith chart theory, this may be obtained by rotating each point of curve (2) about the center of the diagram by an angle proportional to the electrical length of the transformer at the particular frequency corresponding to the frequency of the point to be rotated. The points corresponding to higher frequencies are rotated by an angle greater than the points corresponding to lower frequencies. At the center frequency, where the electrical length of the transformer is approximately one-half wavelength, the rotation is 360° on the diagram. At F2 (the highest frequency), the rotation is greater, at F1 (the lowest frequency), the rotation is less than 360°. This results in a susceptance curve practically reduced to the point J, see FIG. 7(*c*).

Step 4: The final transformation of the susceptance curve is the determination of the susceptance viewed in plane P2 inside the standard guide (on the right side of plane P2 of FIG. 4). This results in a conductive translation of the curve which is reduced to the point J in the opposite direction to the translation used to transform curve (1) into curve (2) as the characteristic admittance change undergone in passing through plane P2 from the left to the right (in FIG. 4) is exactly reversed of the change undergone passing through plane P1. Thus, the curve which is reduced to point J is translated to point I (center of the diagram). Note that the point I is the perfect match point. It is seen that the differential transformer action (curve (2) transformed to point J) for the different frequencies of the bandwidth plays an important role in reducing the spead of the final susceptance curve to the center point of the diagram, see FIG. 7(*d*). This determines that a very good and very broad match may be obtained by the apparatus according to the present invention. Matching is thus obtained for all the frequencies of the band $F_1$ to $F_2$.

It should be pointed out that the window (4,5) must satisfy not only the matching problem but also the problem of rejection of parasitic resonances from the operating frequency band of the ridge waveguide. In order to find a solution which permits rejection of these spurious frequencies, experience has demonstrated the fact that the value at which the plate of dielectric material does not produce any variation in capacitance along the transmission line constituted by the waveguide 1 cannot possibly be adopted as a value b of the small dimension or short side of the plate 4. In point of fact, the long dimension a of the metallic frame 5 should be equal in this case to the internal width A of the ridge waveguide in order to prevent any inductive component which would not be counterbalanced by a capacitive component. In such a case, the volume of the plate 4 would be sufficiently large to introduce ghost modes (parasitic resonances) into the passband of the ridge waveguide. It is therefore necessary to give the short dimension of the plate a value b which is sufficiently small with respect to the smallest value of the short dimension of the plate which would not produce any variation in capacitance along the transmission line. This reduction which gives rise to the appearance of a capacitive component must be canceled by a corresponding inductive component which is a function of the difference A-a (FIG. 5). It should be noted that the reduction of dimension b mentioned in the foregoing must not be excessive since the inductive component required for cancellation of the capacitive component would otherwise become substantial, which would have the effect of increasing the selectivity of the window-type waveguide and is therefore incompatible with the broad-band matching which it is sought to achieve.

By way of example, a waveguide has been constructed in accordance with FIGS. 4 to 6, with:

| | |
|---|---|
| A = 17.55 mm | B = 8.15 mm and the width of the ridge is 4.395 mm (waveguide type WRD 750 D 24) |
| a = 12.7 mm | b = 6.7 mm |
| D = 3.45 mm | d = 3 mm |

length of transformer: 5.7 mm on each side of the window, plate 4 of alumina having a thickness of 0.5 mm, frame 5 of ferronickel having a thickness of 1.5 mm, the results obtained are as follows:

frequency band $F_1$ to $F_2$: 7.4 to 18.2 GHz, frequency of the first parasitic resonance (ghost mode): 18.4 GHz, standing-wave ratio within the frequency band $F_1$ to $F_2$: 1.30, standing-wave ratio at 7 GHz: 1.5.

Figure 8:
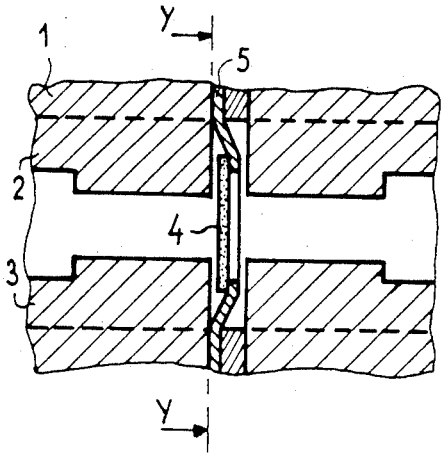
FIGS. 8 to 11 are four sectional views relating to two other waveguides in accordance with the invention.
Figure 9:
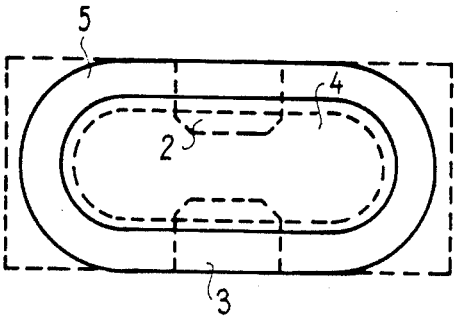

Another example of a sealed-window waveguide in accordance with the invention is illustrated in FIGS. 8 and 9. FIG. 8 is a longitudinal sectional view of a rectangular waveguide 1 having ridges 2, 3, this cross-section being taken along a plane perpendicular to the long sides of the waveguide. FIG. 9 is a transverse sectional view taken along a plane corresponding to the line Y—Y indicated in FIG. 8. A window formed by a metallic frame 5 and a dielectric plate 4 is placed in a transverse plane of the waveguide. Ridge sections having a smaller relative spacing than the ridges in the remainder of the waveguide 1 appear in FIG. 8. These sections constitute the half-wave transformer and the metallic window is placed substantially in the middle of the ridge section. Said window-type waveguide is distinguished from the waveguide shown in FIGS. 4 to 6 by the constructional design of its window. Whereas the frame 5 was machined in the previous case, the frame in this embodiment is obtained by die-stamping of a metallic plate, thus permitting large-scale production at lower cost. Furthermore, again in order to facilitate the construction of the window, the opening of the frame 5 and the periphery of the plate 4 have been given a rectangular shape based on the assumption that two semicircles equal in diameter to the length of the short sides of the rectangle have been placed respectively against the two short sides of said rectangle. Subject to a slight difference in shape, this window-type waveguide corresponds to the waveguide of FIGS. 4 to 6 and has permitted the achievement of the same results with respect to wave transmission and mechanical strength of the window.

The two examples which have just been described relate to windows placed in a transverse plane of the ridge waveguide and each fitted with a dielectric plate 4 of oblong shape, the longest dimension of which was parallel to the long sides of the waveguide in order to equalize the inductive components and capacitive components due to the presence of said plate of dielectric material. In the event that the dielectric plate is no longer oblong but of circular shape, there would no longer be any possibility of equalizing the capacitive and inductive components since the inductive components are always preponderant. It is not possible in this case to obtain a standing-wave ratio lower than 2, even in a frequency band which is reduced to two-thirds of the passband of the waveguide. It is possible on the other hand to incline the circular window in order to produce the same behavior as an oblong window. In fact, when the projection of the dielectric plate on a transverse plane of the waveguide has an oblong shape with its longest dimension parallel to the long sides of the waveguide, it is possible to equalize the inductive components and the capacitive components.

Figure 10:
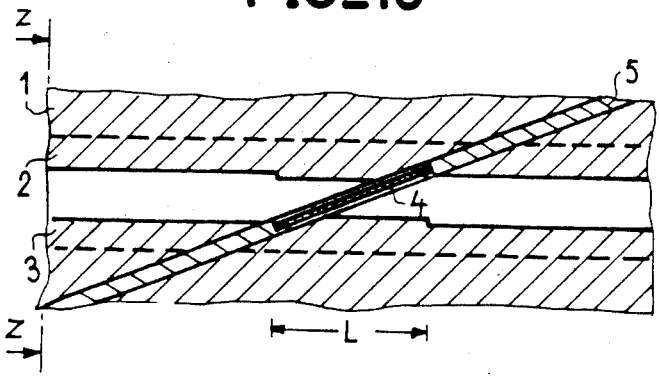
Figure 11:
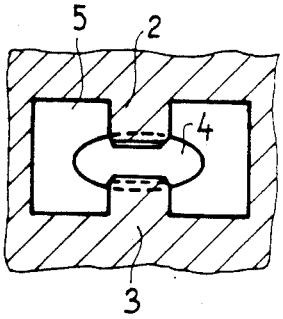

FIGS. 10 and 11 show a waveguide in accordance with the invention, comprising a sloping window (4,5) having a circular plate 4 of dielectric material and a metallic frame 5. FIG. 10, which is a longitudinal view in cross-section taken along the plane of symmetry of the waveguide which is perpendicular to the long sides of this waveguide, shows the waveguide 1 together with its ridges 2, 3 which have a smaller relative spacing over a distance L so as to form a matching transformer. FIG. 11 is a transverse view of the waveguide in cross-section along a plane represented by the line Z—Z in FIG. 10. This figure shows that, in the section plane, the major axis (not shown) of the ellipse of projection of the plate 4 is parallel to the long sides of the waveguide.

In the three examples of construction which have been described with reference to FIGS. 4 to 6 and 8 to 11, the plate 4 of ceramic material is joined to the ferronickel frame 5 by flat-position brazing. In other words, the brazing compound placed between the plate 4 and the frame 5 is in contact with the plate only on one face of this plate and forms a closed bead or fillet, the outer edge of which is flush with the edge of the face considered. However, any other method of attachment may be contemplated on condition that it ensures strength and leak-tightness of the window. Alternative methods include brazing on the edge faces of the plate or a combination of edge-brazing with flat brazing, adhesive bonding, and so on. A further point worthy of note is that, in order to facilitate brazing of the ceramic plate to the frame, it may prove advantageous to interrupt the ridges at a short distance before the window, for example over a distance of one to five tenths of a millimeter.

The present invention is not limited to the examples described in the foregoing. Thus in the case of the opening, any oblong shape or any shape having an oblong transverse projection would be suitable insofar as it permits the achievement of equilibrium of the capacitive and inductive components. Similarly, although it is essential to ensure that the window (4,5) is located in the zone of the impedance transformer (ridge sections 20, 21, 30, 31 of FIG. 4), said window need not necessarily be located at the center of said zone. In addition, the ridges need not be symmetrical, even in the zone of the impedance transformer. Even a waveguide having only one ridge is suitable for the purpose of constructing a window-type waveguide in accordance with the invention.

The present invention is particularly applicable to the construction of microwave power windows which are capable of operating within a frequency bandwidth greater than one octave without any parasitic frequencies in the operating band.

What is claimed is:

1. A rectangular ridge waveguide having a first opening bounded by long and short sides, a propagation direction substantially perpendicular to a plane parallel to said first opening, waveguide ridges aligned along the waveguide parallel to said propagation direction, and a sealed thin window forming a partition-wall interposed so as to define two adjoining sections in the waveguide, said window being composed of a metallic frame and a substantially thin dielectric plate, the plate having a thickness representing an electric length at least five times shorter than a guided wavelength corresponding to a signal at the highest operating frequency of said waveguide, the frame being pierced by a second opening, and said second opening is sealed by said dielectric plate, the projection of said second opening on said plane perpendicular to said propagation direction being of oblong shape, the longest dimension of said oblong shape being parallel to the long sides of the waveguide, the shortest dimension of said oblong shape being parallel to said short sides, the longest and shortest dimensions of said oblong shape which are parallel respectively to the long and short sides of the waveguide are respectively smaller than the dimensions of said long and short sides of the waveguide, said waveguide being provided with a matching transformer placed in a zone of said waveguide surrounding said window, said zone having a length parallel to said propagation direction, and said length being approximately $\lambda_0/2$, where $\lambda_0$ is a wavelength corresponding to a center operating frequency of said waveguide, said transformer being obtained by giving the waveguide ridges a greater thickness inside the zone than outside the zone.

2. A waveguide according to claim 1, wherein the window is oriented perpendicular to said propagation direction.

3. A waveguide according to claim 2, wherein the plate is given the shape of a rectangle having rounded corners.

4. A waveguide according to claim 2, wherein the plate is given the shape of a rectangle joined to two semicircles, the rectangle having long and short sides with the long sides of the rectangle parallel to the long sides of the waveguide and the semicircles being equal in diameter to the length of the short sides of the rectangle and being placed against the two short sides of said rectangle.

5. A waveguide according to claim 1, wherein the window is inclined with respect to said plane perpendicular to said propagation direction.

6. A waveguide according to claim 5, wherein the plate is of circular shape with a diameter parallel to the long sides of the waveguide.

7. A waveguide according to claim 4, wherein the frame is a die-stamped metallic plate.

8. A waveguide according to claim 6 wherein said circular shape plate is inclined with respect to said plane perpendicular to said propagation direction to form said oblong projection on said plane.

* * * * *